US006544153B2

(12) United States Patent
Lee

(10) Patent No.: US 6,544,153 B2
(45) Date of Patent: Apr. 8, 2003

(54) EXERCISE WHEEL

(76) Inventor: Chin-Tsun Lee, No. 32, Lane 6, Kuokuang 7th St., Yung Kang City, Tainan Hsien (TW)

( * ) Notice: Subject to any disclaimer, the term of this patent is extended or adjusted under 35 U.S.C. 154(b) by 83 days.

(21) Appl. No.: 09/908,028

(22) Filed: Jul. 19, 2001

(65) Prior Publication Data

US 2003/0017921 A1 Jan. 23, 2003

(51) Int. Cl.[7] ..... A63B 21/22

(52) U.S. Cl. ..... 482/136; 482/127; 482/132; 482/907

(58) Field of Search ..... 482/62, 132, 136, 482/127, 407, 116, 121, 126

(56) References Cited

U.S. PATENT DOCUMENTS 6,146,318 A * 11/2000 Kuo ..... 482/132
6,196,995 B1 * 3/2001 Chuang ..... 482/132
6,254,518 B1 * 7/2001 Yu ..... 482/140

* cited by examiner

*Primary Examiner*—Glenn E. Richman
(74) *Attorney, Agent, or Firm*—Charles E. Baxley

(57) ABSTRACT

An exercise wheel comprises a housing, two grip rods respectively secured to two sides of the housing, a chassis housed by the housing, a main shaft supported by the chassis, a main gear mounted around the main shaft, two wheel assemblies, and two torsion springs. Each wheel assembly is rotatably mounted to the chassis and includes a shaft with a toothed portion for meshing with the main gear. The torsion springs are mounted around the main shaft and respectively located on both sides of the main gear. Each torsion spring includes a first end securely attached to the housing and a second end securely attached to the main gear. The main gear comprises a peripheral stop surrounding at least one of the torsion springs to thereby avoid radial outward expansion of the torsion springs resulting from movements of the wheel assemblies in a rearward direction.

16 Claims, 14 Drawing Sheets

EXERCISE WHEEL

BACKGROUND OF THE INVENTION

1. Field of the Invention

The present invention relates to an exercise wheel that prevents damage to the torsion springs resulting from operation of the exercise wheel in the wrong direction and that prevents excessive travel thereof.

2. Description of the Related Art

FIGS. 12 and 13 of the drawings illustrates a conventional exercise wheel that includes a housing 1', two grip rods 2', a main gear 3', two roller pairs 4', and two torsion springs 5'. The housing 1' includes a compartment with a downwardly facing opening and aligned holes 11' on two sides thereof into which the grip rods 2' are mounted. Two stop rods 12' are mounted inside the housing 1' . The main gear 3' is mounted to the grip rods 2' and includes a hole 32' on each side thereof. Each roller pair 4' includes two rollers 41' connected by a shaft 42' that has teeth 421' formed on an outer periphery thereof for meshing with teeth 31' of the main gear 3'. Each torsion spring 5' includes two ends 51' and 52' that are attached to an associated hole 32' of the main gear 3' and an associated stop rod 12', respectively.

When in use, the user bends downward and grasps the grip rods 2' to make the roller pairs 4' to roll on the ground. During rolling of the roller pairs 4', the torsion springs 5' are tensioned by the main gear 3' via transmission of the teeth 421' and 31'. When the main gear 3' is turned for one turn, the end 52' of the torsion spring 51' bears against the stop rod 12' and thus stops the main gear 3' and the roller pairs 4'. The torsion springs 51' may return the exercise wheel to its initial position.

Nevertheless, when the user operates the main gear 3' in the wrong direction, the torsion springs 5' might be damaged, as the torsion springs are twisted in the wrong direction and thus expand radially outward, as shown in FIG. 14.

SUMMARY OF THE INVENTION

It is an object of the present invention to provide an exercise wheel that may prevent damage to the torsion springs when the exercise wheel is operated in the wrong direction and that prevents excessive travel thereof.

In accordance with a first aspect of the invention the invention, an exercise wheel comprises:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the housing and a second end securely attached to the main gear;

the main gear comprising a peripheral stop surrounding at least one of the torsion springs to thereby avoid radial outward expansion of the torsion springs resulting from movements of the wheel assemblies in a rearward direction.

In accordance with a second aspect of the invention, an exercise wheel comprises:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the housing and a second end securely attached to the main gear;

the main gear comprising two free rotating sections such that the main gear rotates freely when the toothed portions of the shafts of the wheel assemblies respectively come in contact with the free rotating sections of the main gear.

In accordance with a third aspect of the invention, an exercise wheel comprises:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the housing and a second end securely attached to the main gear;

the main gear comprising two stops that respectively come in contact with the toothed portions of the wheel assemblies for preventing further forward movement of the wheel assemblies after the wheel assemblies have been moved forwardly for a distance.

In accordance with a fourth aspect of the invention, an exercise wheel comprises:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear;

two torsion springs mounted around the main shaft and respectively located on both sides of the main gear, each said torsion spring including a first end securely attached to the housing, a coil portion, and a second end securely attached to the main gear; and two sleeves respectively mounted around the coil portions of the torsion springs and securely attached to the main gear, each said sleeve comprising a notch through which the second end of a respective said torsion spring extends;

wherein when the exercise wheel moves in a rearward direction, an end edge defining the notch restrains movement of the second end of the respective torsion spring and the sleeve restrains radially outward expansion of the coil portion of the respective torsion spring, thereby preventing damage to the torsion springs.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
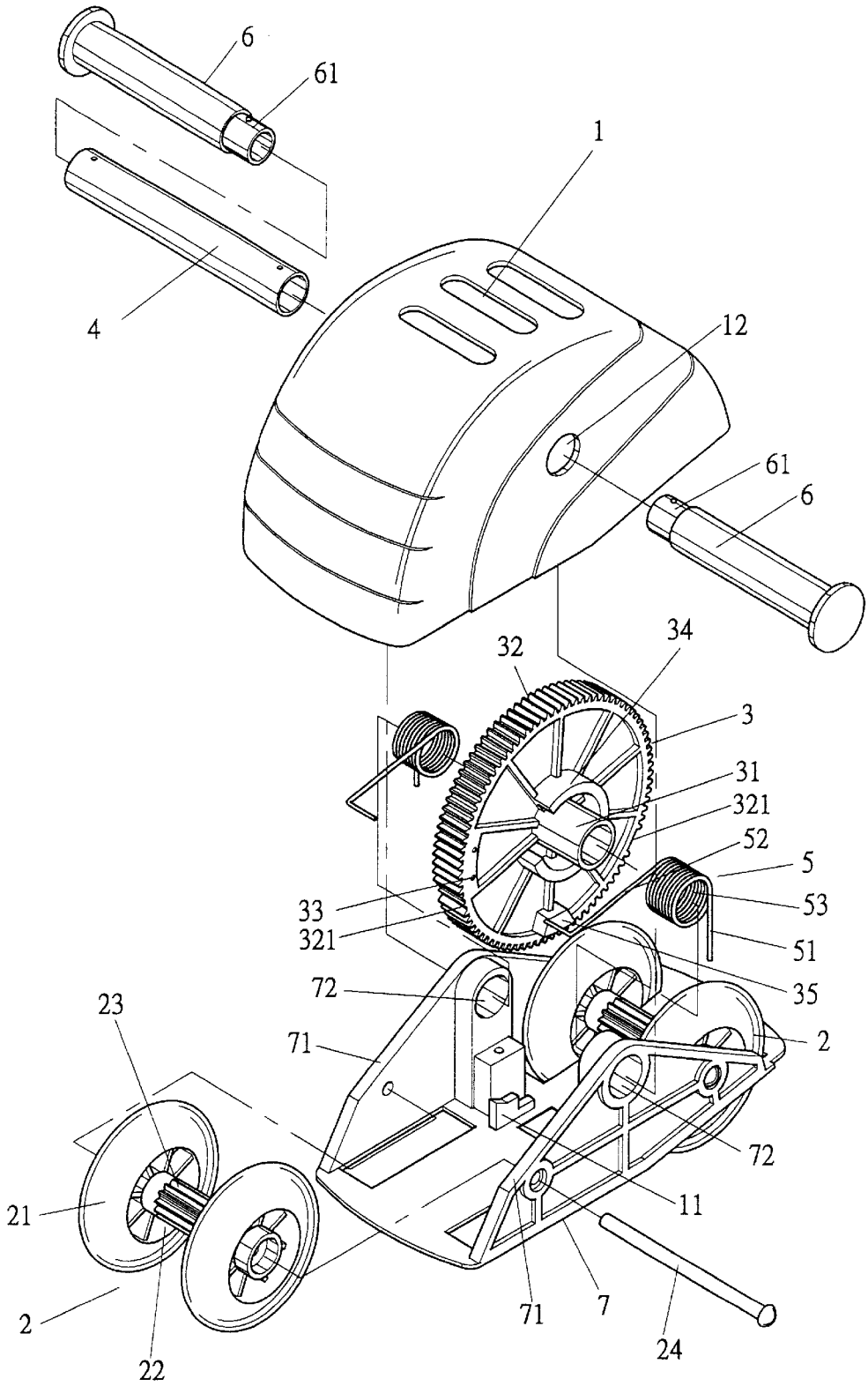
FIG. 1 is an exploded perspective view of an exercise wheel in accordance with the present invention.
Figure 2:
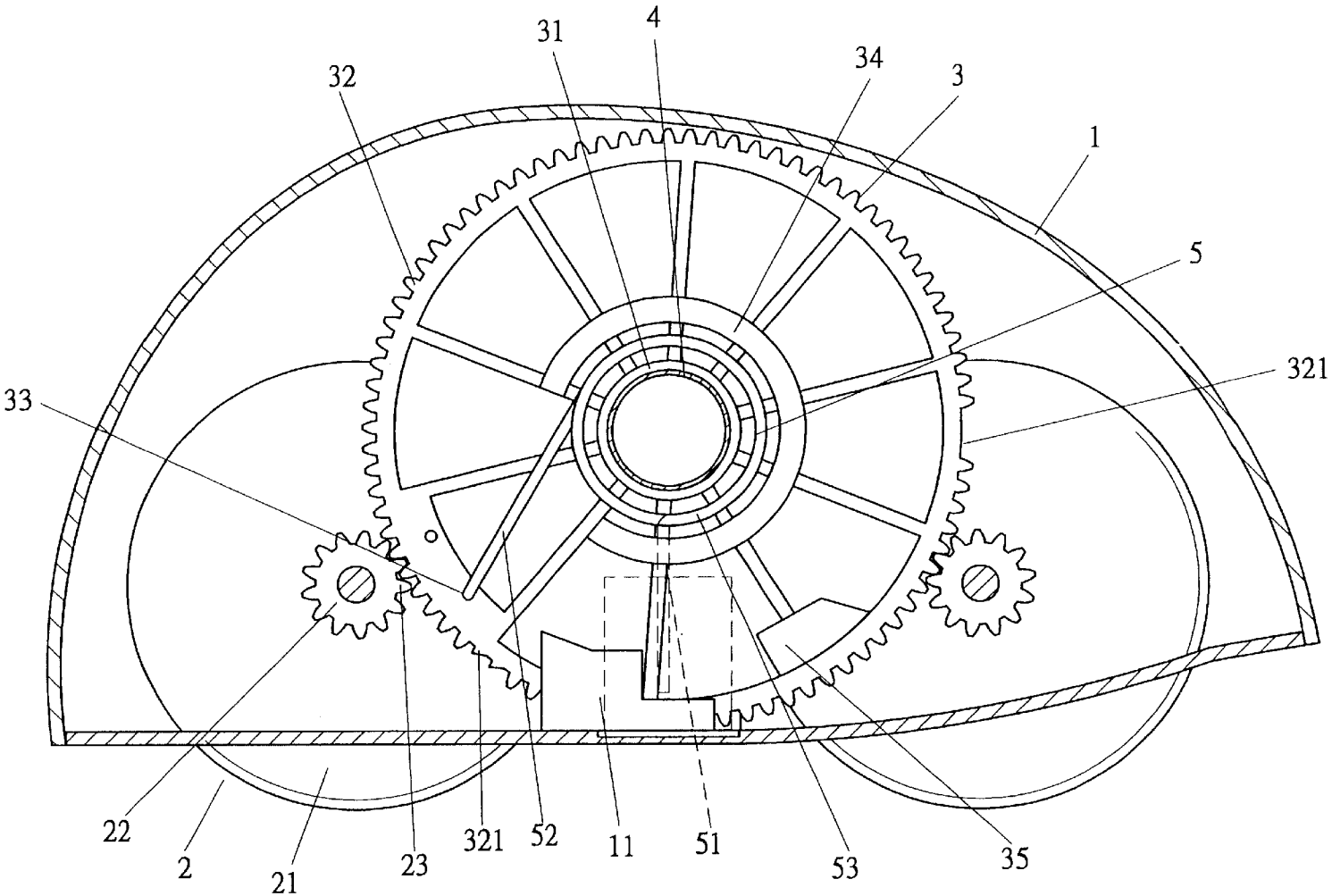
FIG. 2 is a sectional view of the exercise wheel in FIG. 1.

Referring to FIGS. 1 through 4 and initially to FIGS. 1 and 2, an exercise wheel in accordance with the present invention generally includes a housing 1, a chassis 7 housed in the housing 1, two wheel assemblies 2, a main shaft 4, and two grip rods 6. The housing 1 includes aligned holes 12 in two sides thereof for mounting the grip rods 6. More specifically, each grip rod 6 includes an end 61 that is secured in an associated hole 12 of the housing 1. The chassis 7 includes two side walls 71 having aligned holes 72 for rotatably receiving the main shaft 4. The end 61 of each grip rod 6 extends through an associated hole 72 and then engaged with an associated end of the main shaft 4. However, the grip rods 6 may directly be attached to the housing 1. The chassis 7 further comprises a stop 11, which will be described later.

Each wheel assembly 2 includes a pair of wheels 21 connected by a hollow shaft 22, which, in turn, is mounted around an associated axle rod 24 that extends through the side walls 71 of the chassis 7, thereby allowing rotational movement of the wheels 21. The main gear 3 includes a hub 31 that is mounted around the main shaft 4. The main gear 3 includes peripheral teeth 32 on an outer periphery thereof for meshing with a toothed portion 23 of the hollow shaft 22 of each wheel assembly 2. It is noted that the outer periphery of the main gear 3 comprises two free rotating sections 321 (two ratcheted sections in an embodiment) to make the main gear 3 rotate freely when the exercise wheel moves in the wrong direction. In addition, a click is generated when the tooth of the toothed portion 23 of the respective wheel assembly 2 moves across the respective ratcheted section 321 of the main gear 3 to thereby alarm the user that the exercise wheel is moving in the wrong direction. In a particular embodiment, as illustrated in FIG. 2, one of the free rotating sections 321 (the right one in FIG. 2) is a flat section without any tooth, and the other free rotating section 321 (the left one in FIG. 2) is a ratcheted section. The main gear 3 further comprises a stop 35 for cooperating with the stop 11 on the chassis 7 for preventing excessive forward travel of the main gear 3.

The torsion springs 5 are mounted around the hub 31 and respectively located on both sides of the main gear 3. Each torsion spring 5 includes a first end 51 attached to the housing 1 and a second end 52 attached to a positioning hole 33 on an associated side of the main gear 3. The main gear 3 further includes a peripheral stop 34 surrounding at least one (preferably both) of the coil portions 53 of the torsion springs 5 to thereby avoid radial outward expansion of the torsion springs 5.

Figure 3:
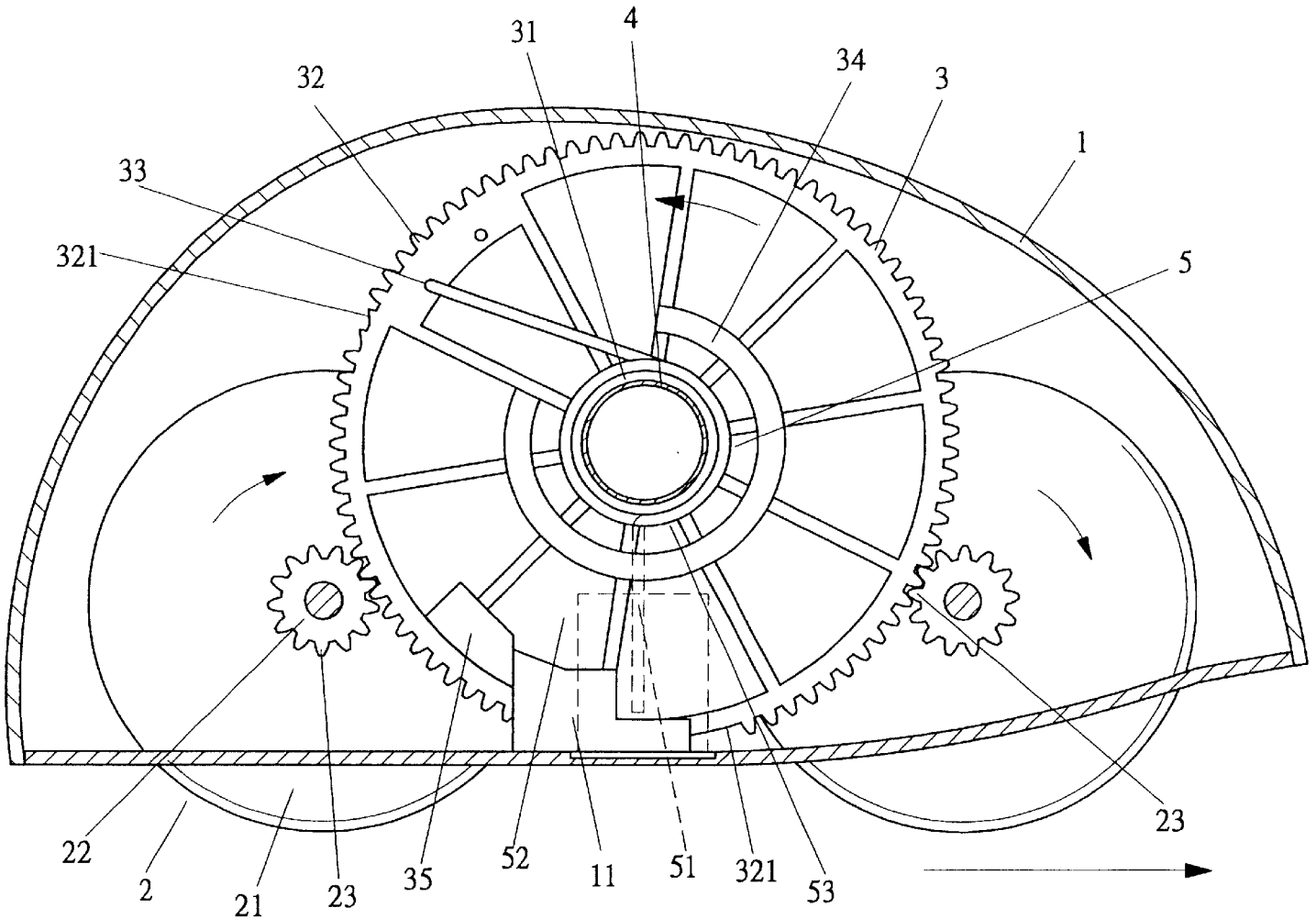
FIG. 3 is a sectional view similar to FIG. 2, illustrating forward travel of the exercise wheel.

When the exercise wheel is moved in a forward direction, as shown in FIG. 3, the main gear 3 rotates when the wheels 21 moves forward. Each torsion spring 5 is twisted in a direction in which the diameter of the coil portion 53 of the torsion spring 5 reduces. When the exercise wheel is returned to its initial position under the action of the torsion springs 5, the wheel assemblies 2 are also returned.

Figure 4:
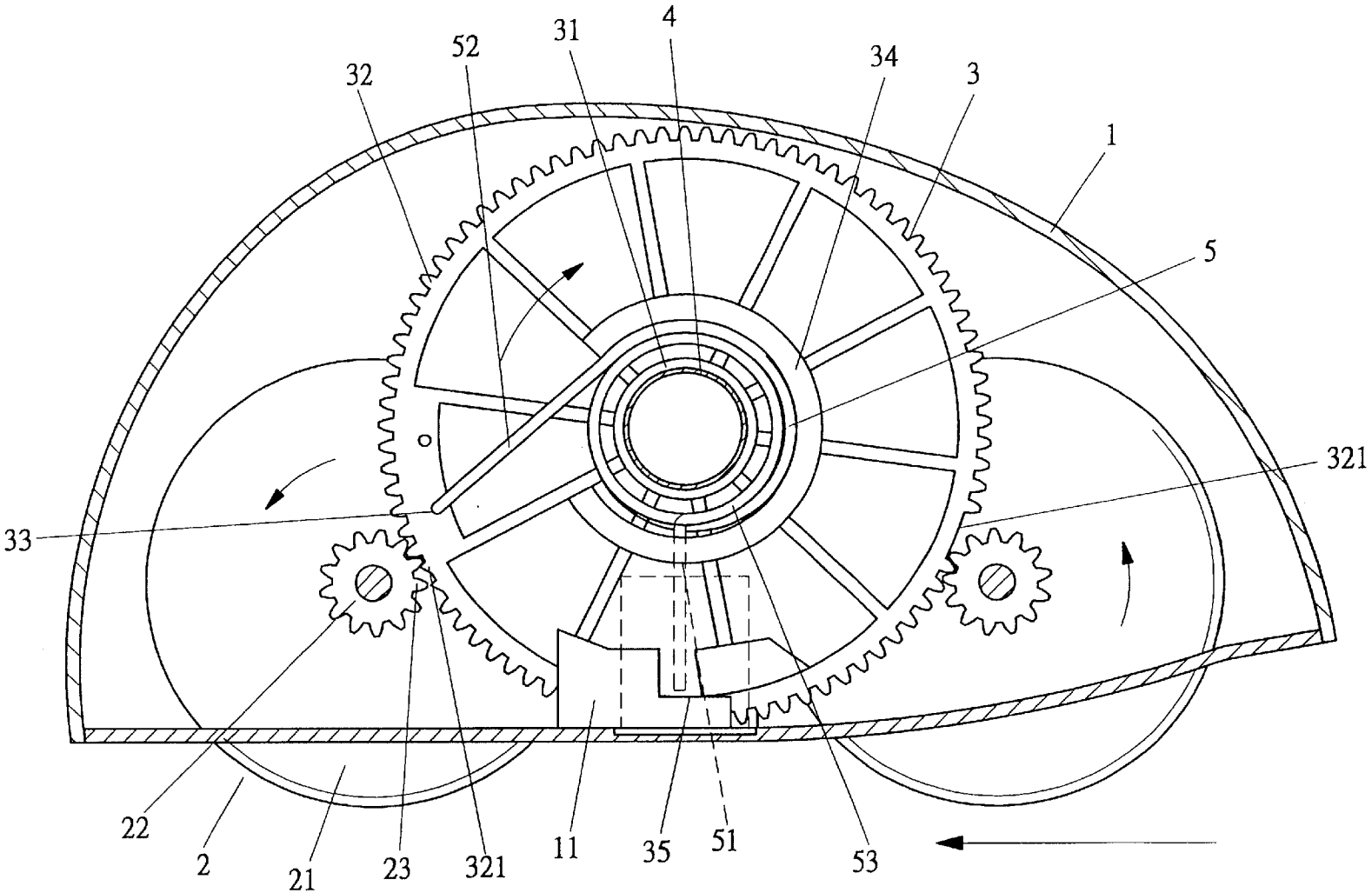
FIG. 4 is a schematic view similar to FIG. 2, illustrating reverse travel of the exercise wheel.

Referring to FIG. 4, when the user operates the exercise wheel in the wrong direction (namely, the rearward direction), the main gear 3 rotates freely when the toothed portions 23 of the wheel assemblies 2 respectively engage with the flat section 321 and the ratcheted section 321 of the main gear 3. In addition, a click is generated when the tooth of the toothed portion 23 of the respective wheel assembly 2 moves across the ratcheted section 321 of the main gear 3 to thereby alarm the user that the exercise wheel is moving in the wrong direction, as mentioned above. In addition, the peripheral stop 34 on the main gear 3 prevents radially outward expansion of the coil portions 53 of the torsion springs 5 to thereby reliably prevent damage to the torsion springs 5 and to thereby prevent rearward movement of the exercise wheel.

Figure 5:
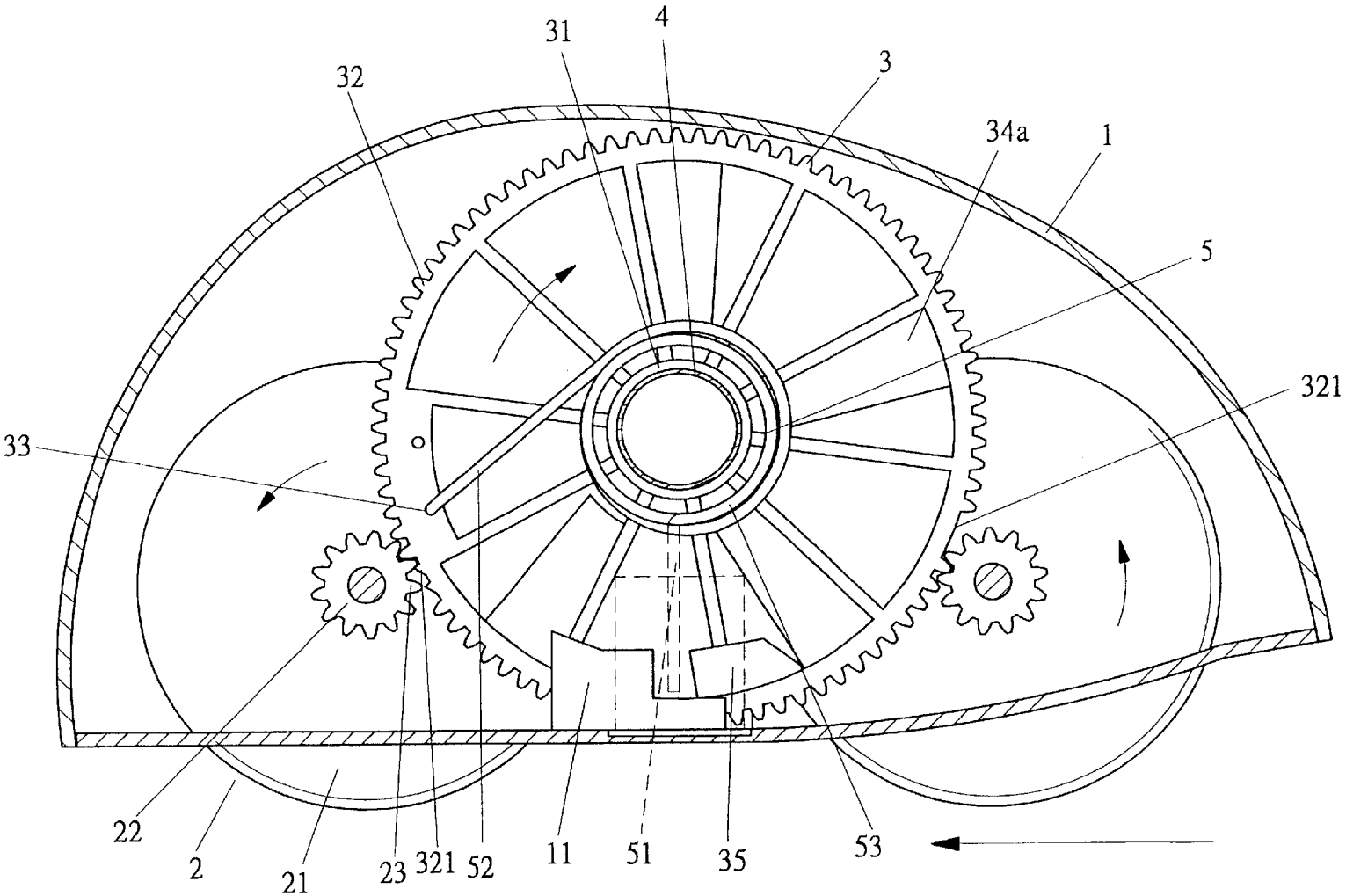
FIG. 5 is a sectional view of a modified embodiment of the exercise wheel in accordance with the present invention.

FIG. 5 illustrates a modified embodiment of the peripheral stop 34 of the main gear 3. In this embodiment, the peripheral stop 34 comprises a plurality of annularly spaced blocks 34*a*. The annularly spaced blocks 34*a* also serve to prevent radially outward expansion of the torsion springs 5 as a result of rearward movement of the exercise wheel.

Figure 6:
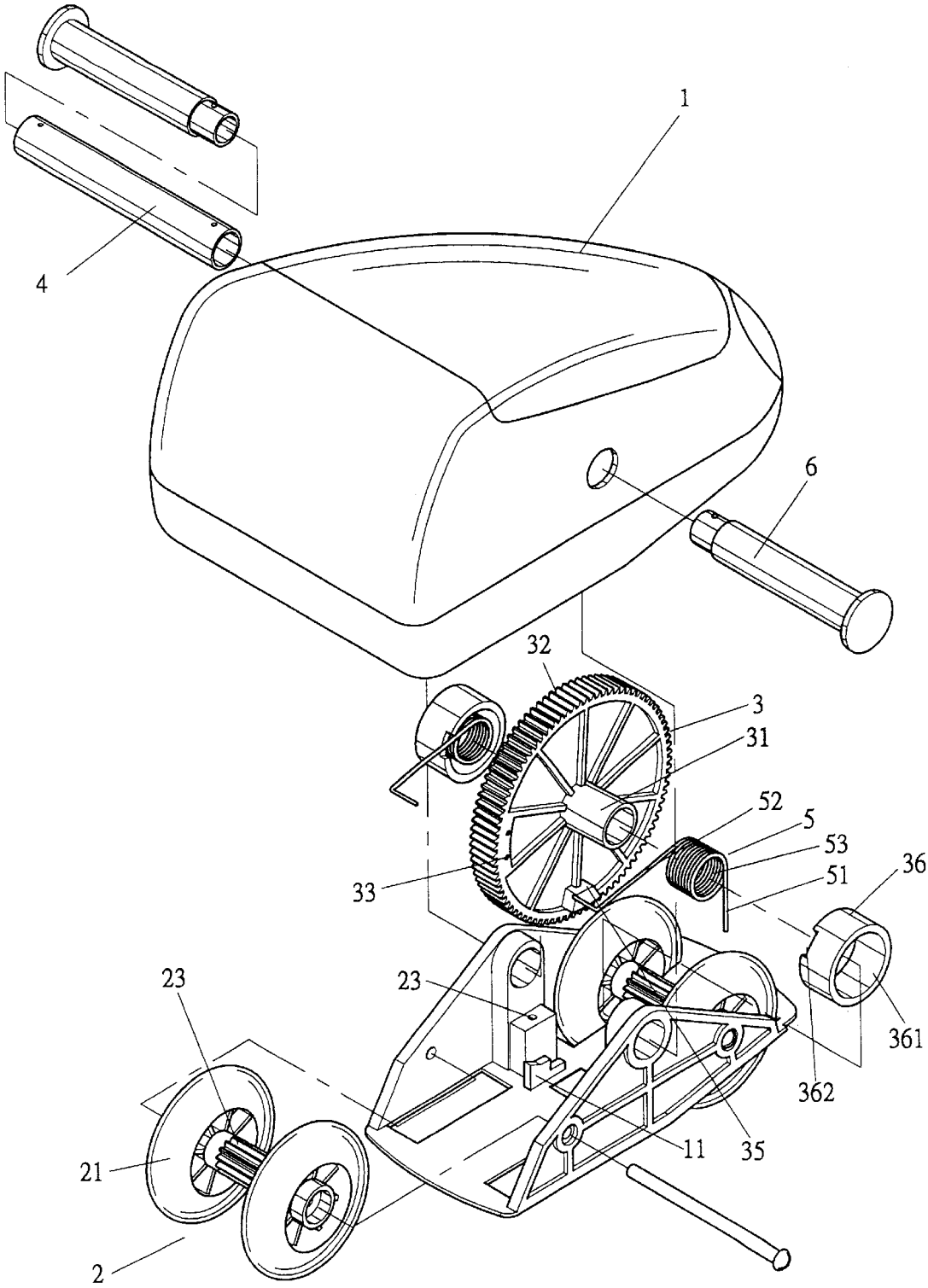
FIG. 6 is an exploded perspective view of another modified embodiment of the exercise wheel in accordance with the present invention.
Figure 7:
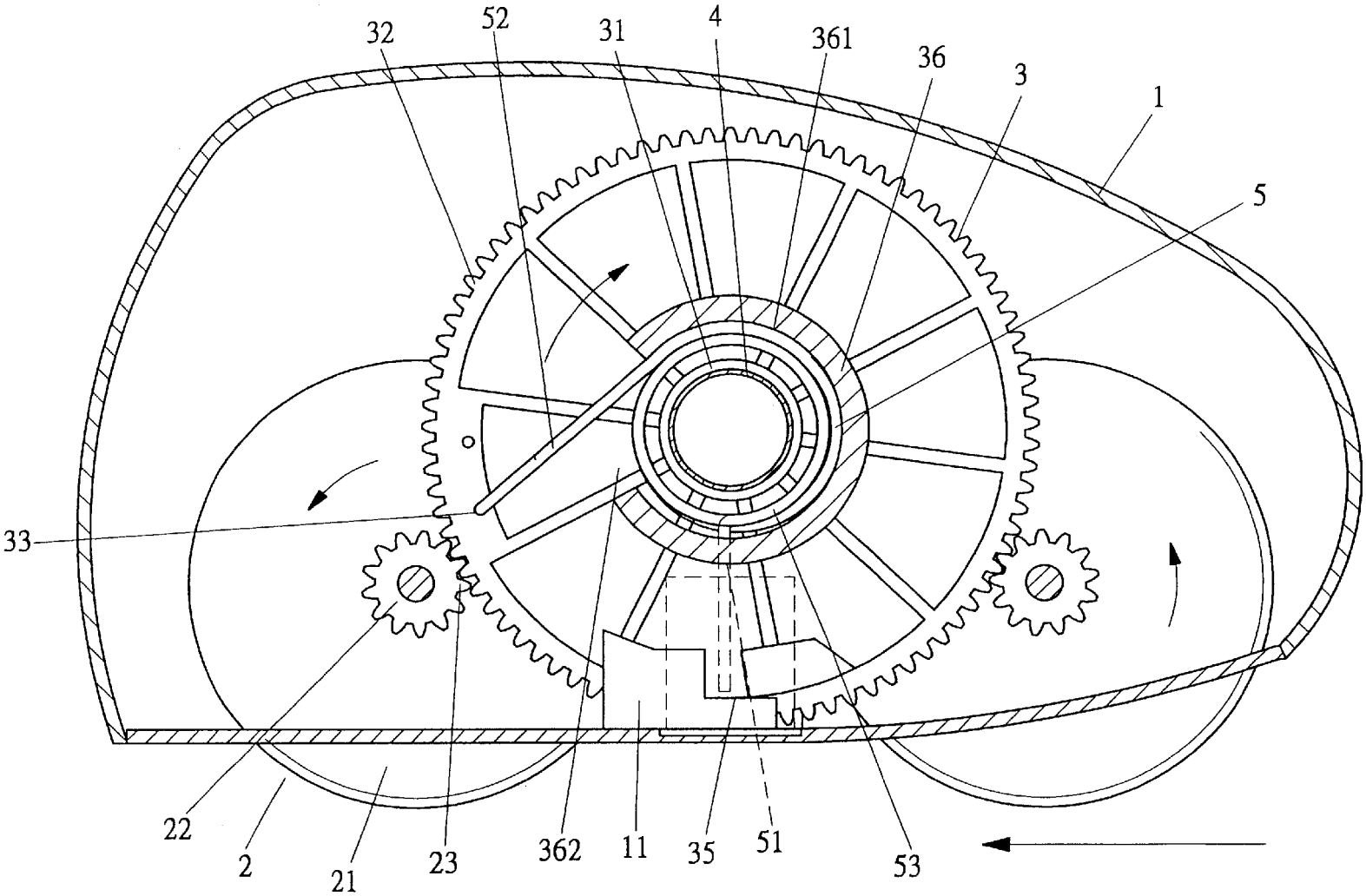
FIG. 7 is a sectional view of the exercise wheel in FIG. 6.
Figure 8:
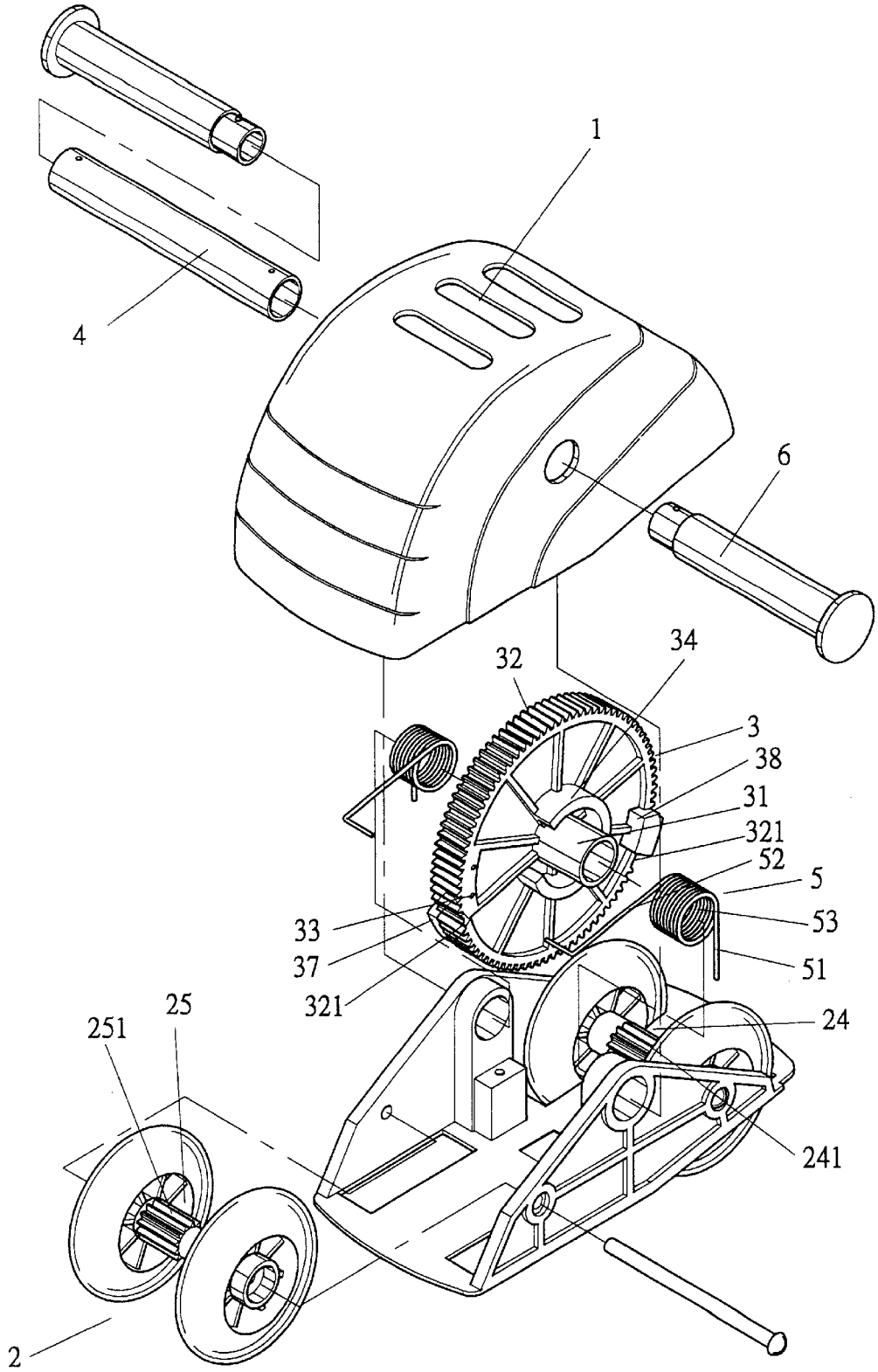
FIG. 8 is an exploded perspective view of a further modified embodiment of the exercise wheel in accordance with the present invention.

FIGS. 6 and 7 illustrate another modified embodiment of the exercise wheel in accordance with the present invention. The free rotating sections 321 and the peripheral stop 34 in the above embodiment are omitted. Instead, in this embodiment, two sleeves 36 are securely attached to both sides of the main gear 3, respectively. Each sleeve 36 comprises a bore 361 having a diameter slightly greater than the coil portion 53 of the respective torsion spring 5. An end edge defining each sleeve 36 further includes a notch 362 through which the second end 52 of the respective torsion spring 5 extends. The notch 362 restrains movement of the second end 52 of the respective torsion spring 5 and the sleeve 36 restrains radial outward expansion of the coil portion 53 of the respective torsion spring 5 when the exercise wheel moves in the wrong direction, thereby preventing damage to the torsion spring 5.

It is noted that the free rotating sections 321, the stops 34, 35, and 11, and the sleeves 36 can be provided independently to avoid damage to the torsion springs 5 when the exercise wheel moves in the wrong direction.

Figure 9:
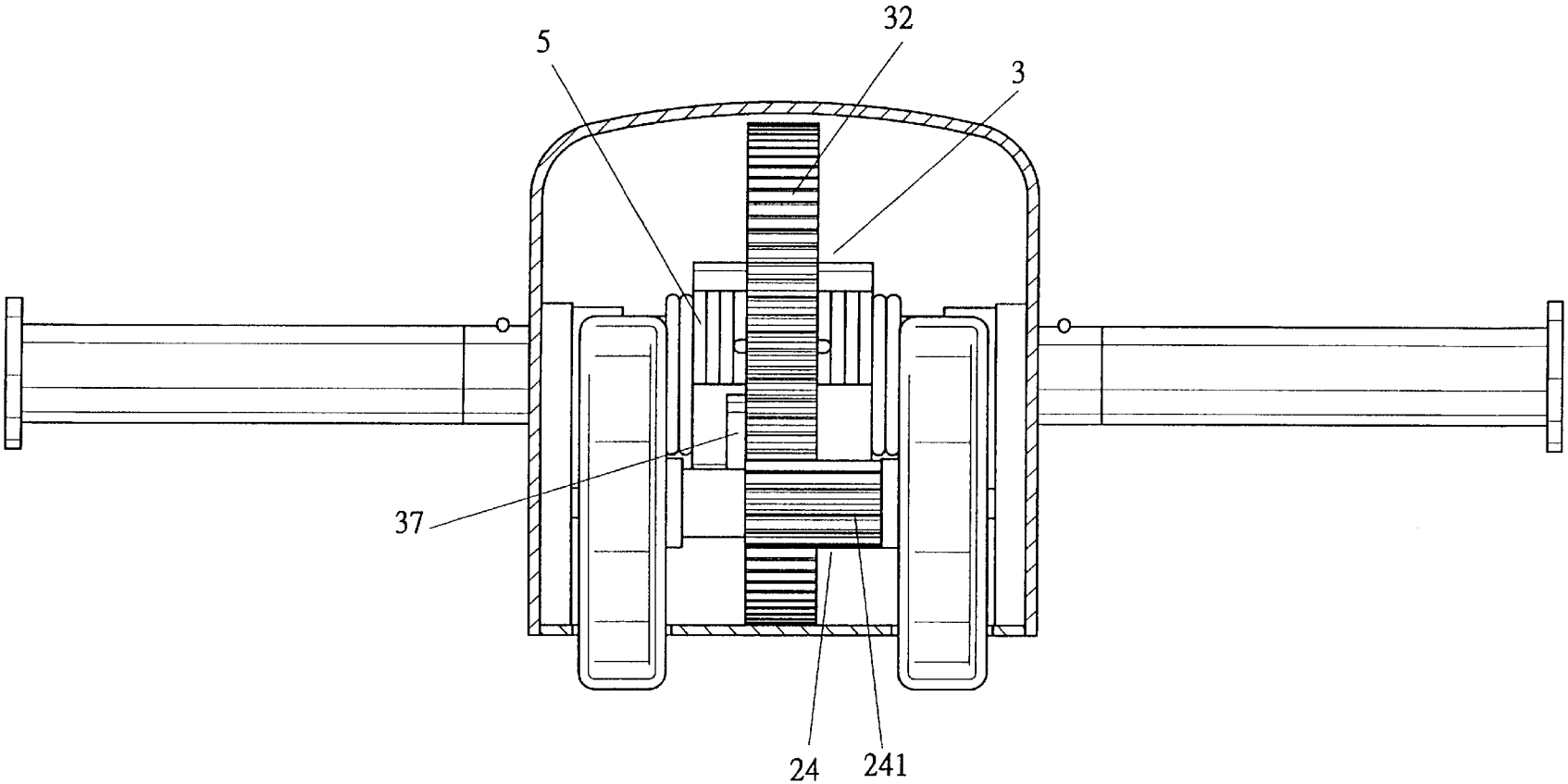
FIG. 9 is a sectional view showing forward movement of the exercise wheel in FIG. 8.
Figure 10:
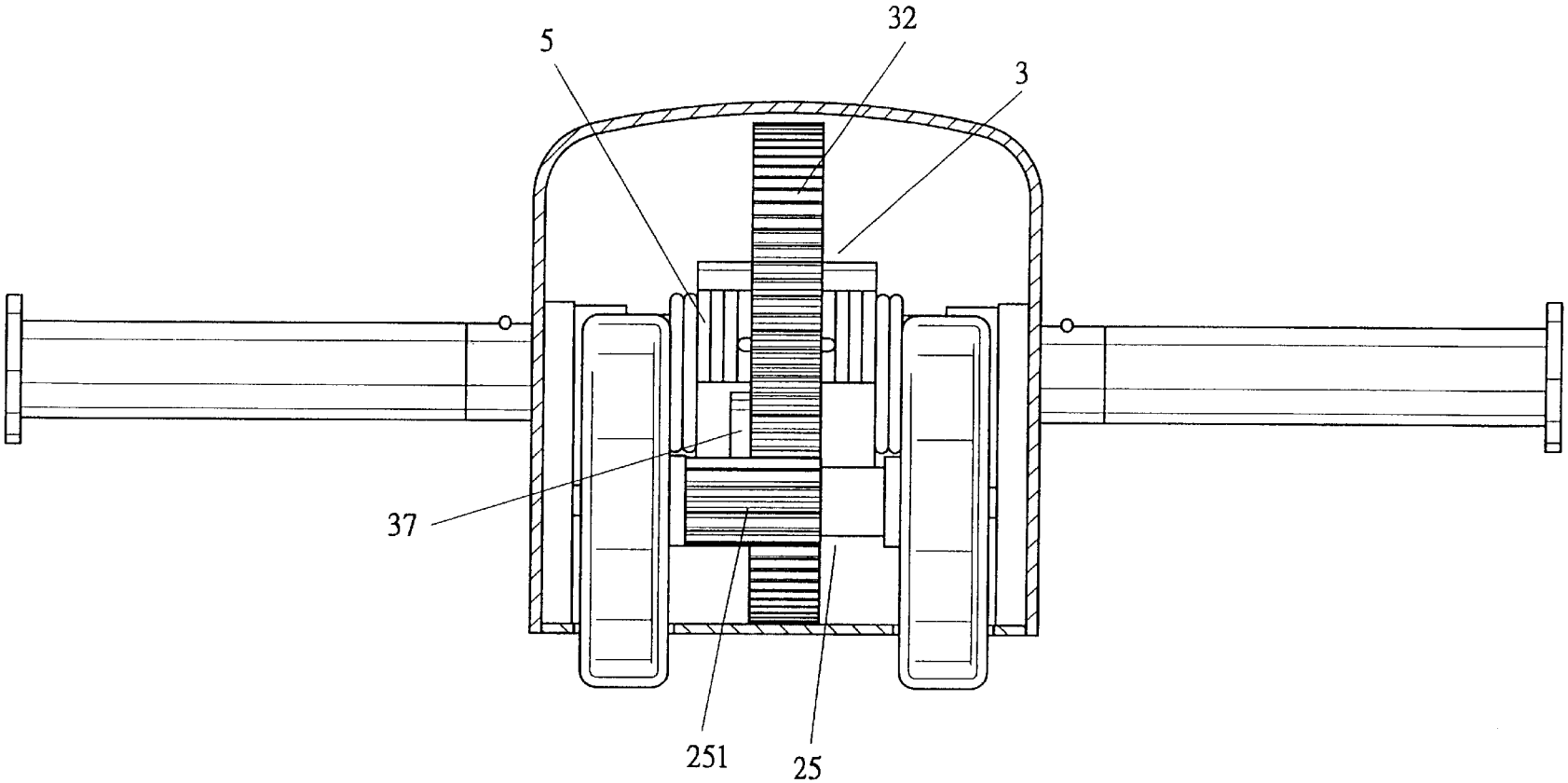
FIG. 10 is another sectional view showing further forward movement of the exercise wheel in FIG. 8.
Figure 11:
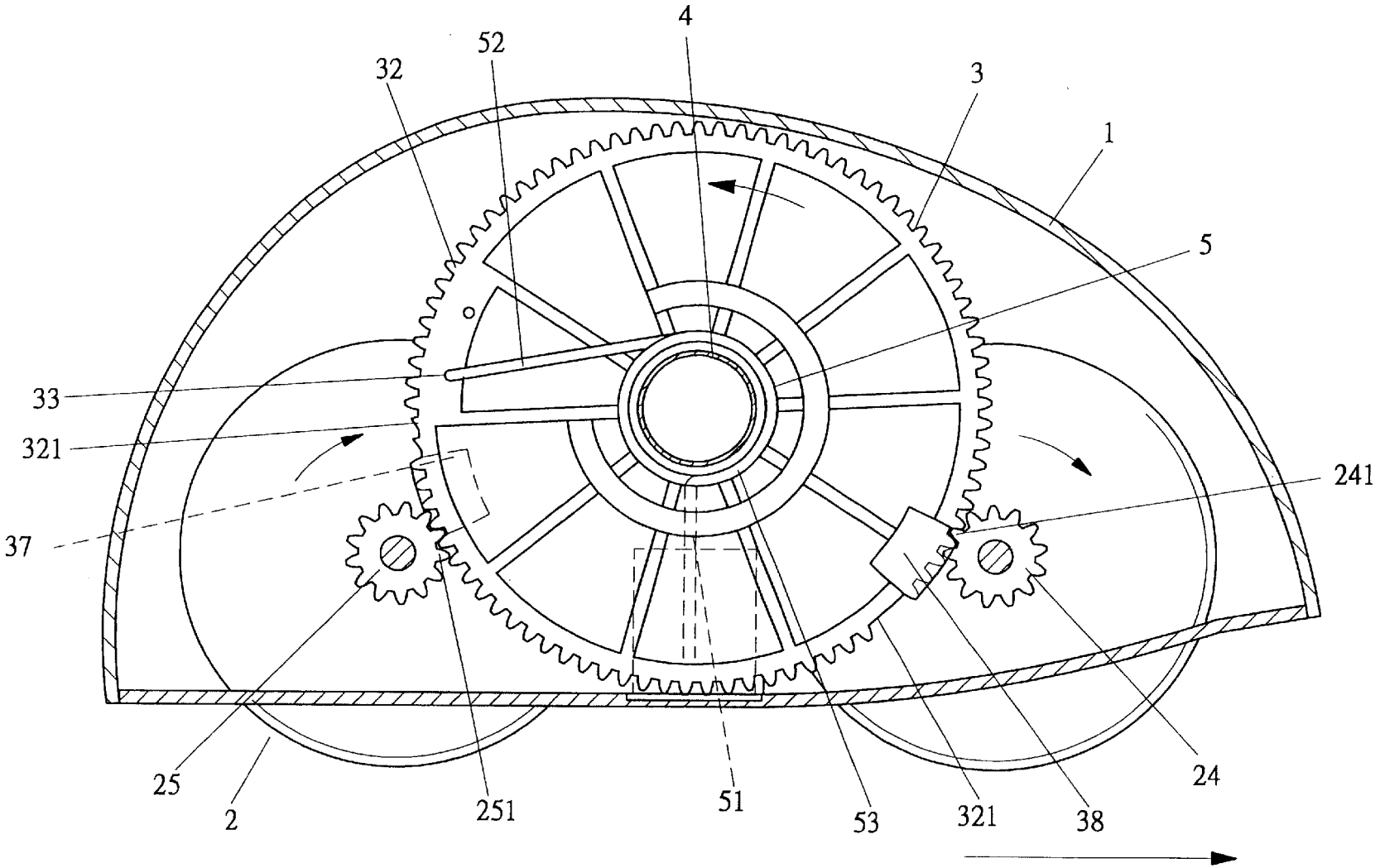
FIG. 11 is a sectional view taken along a longitudinal plane of the exercise wheel in FIG. 8, illustrating prevention of excessive forward movement of the exercise wheel.
Figure 12:
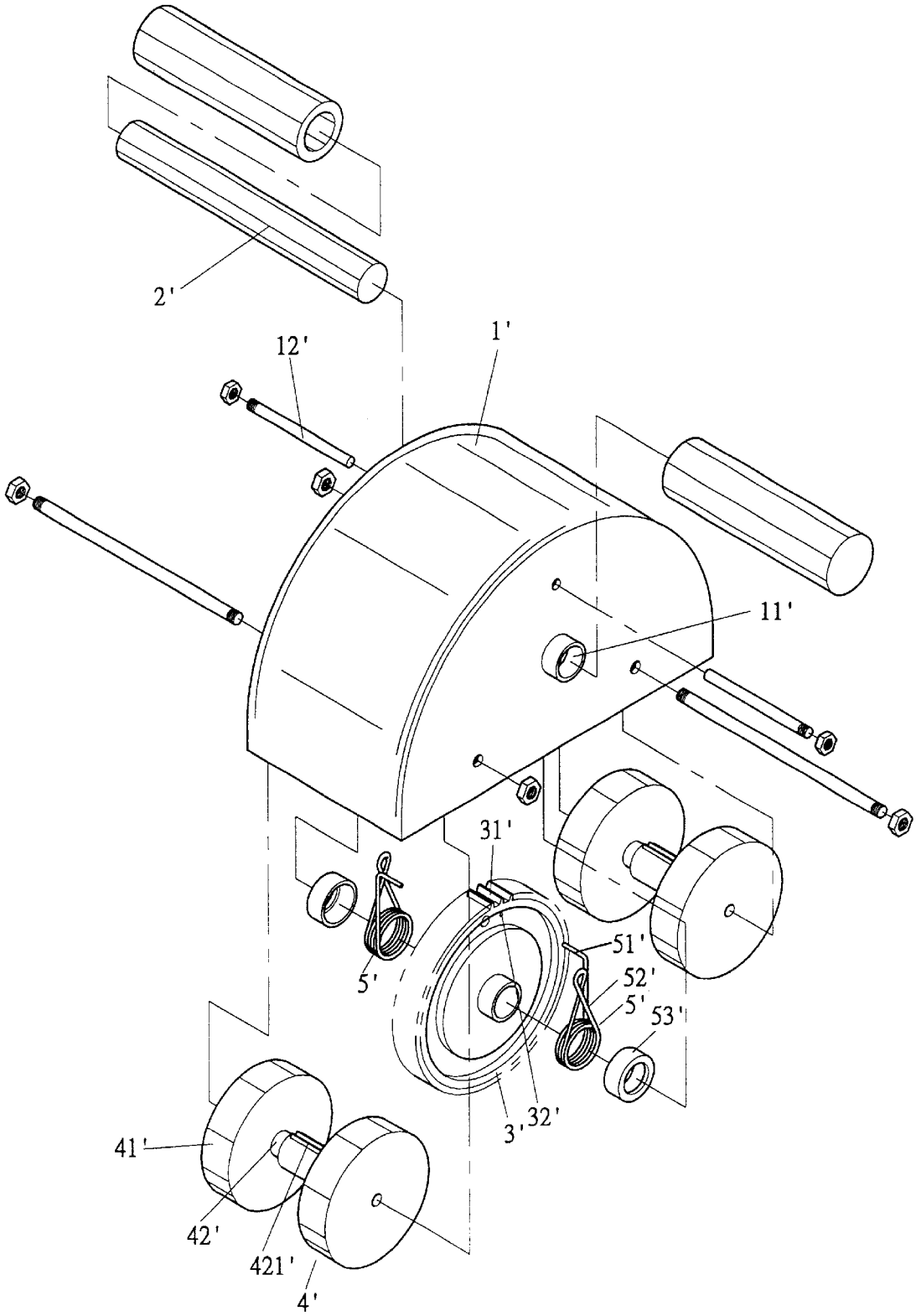
F I G . 12(PRIOR ART)
FIG. 12 is an exploded perspective view of a conventional exercise wheel.
Figure 13:
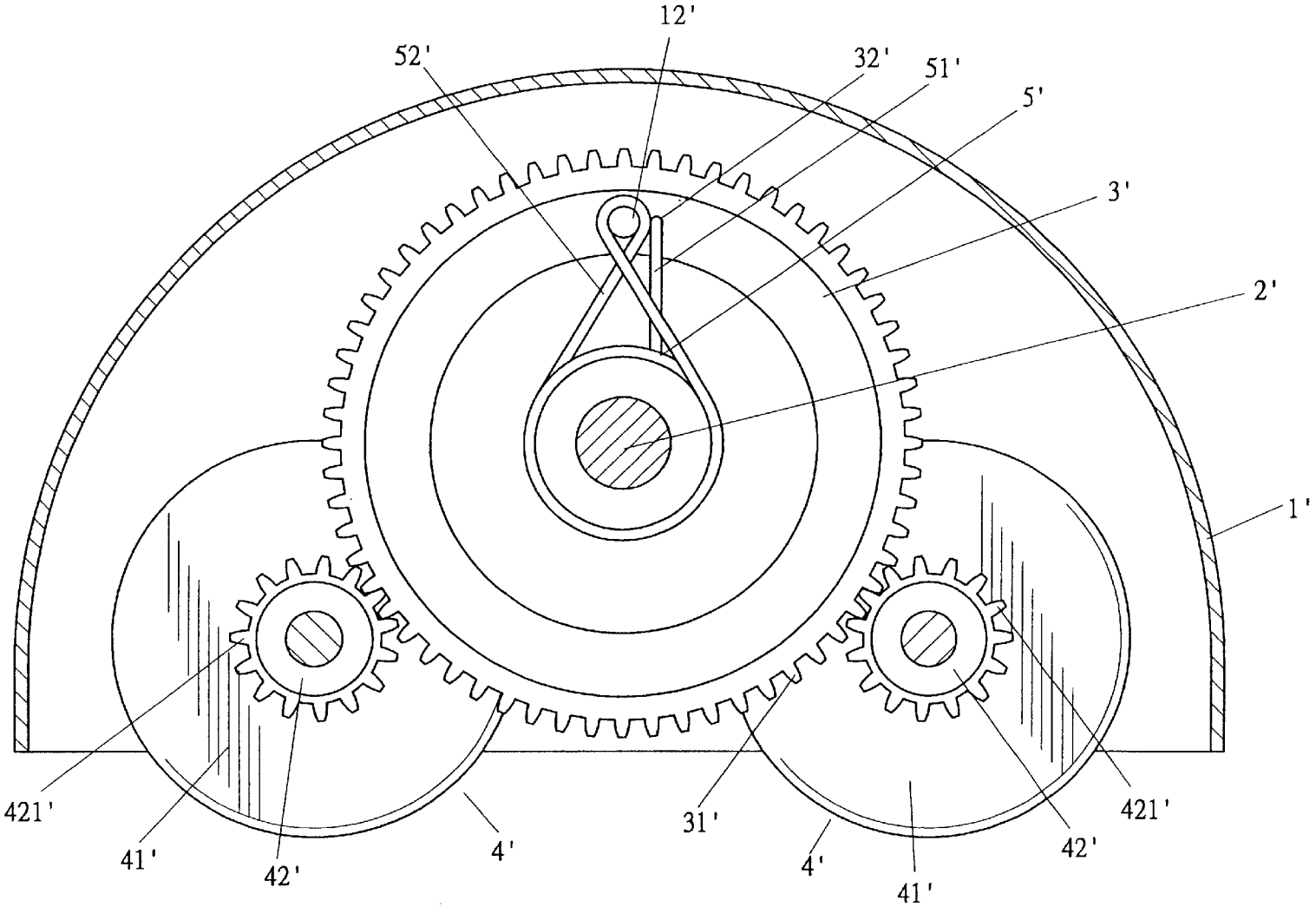
FIG. 13(PRIOR ART)
FIG. 13 is a sectional view of the conventional exercise wheel.
Figure 14:
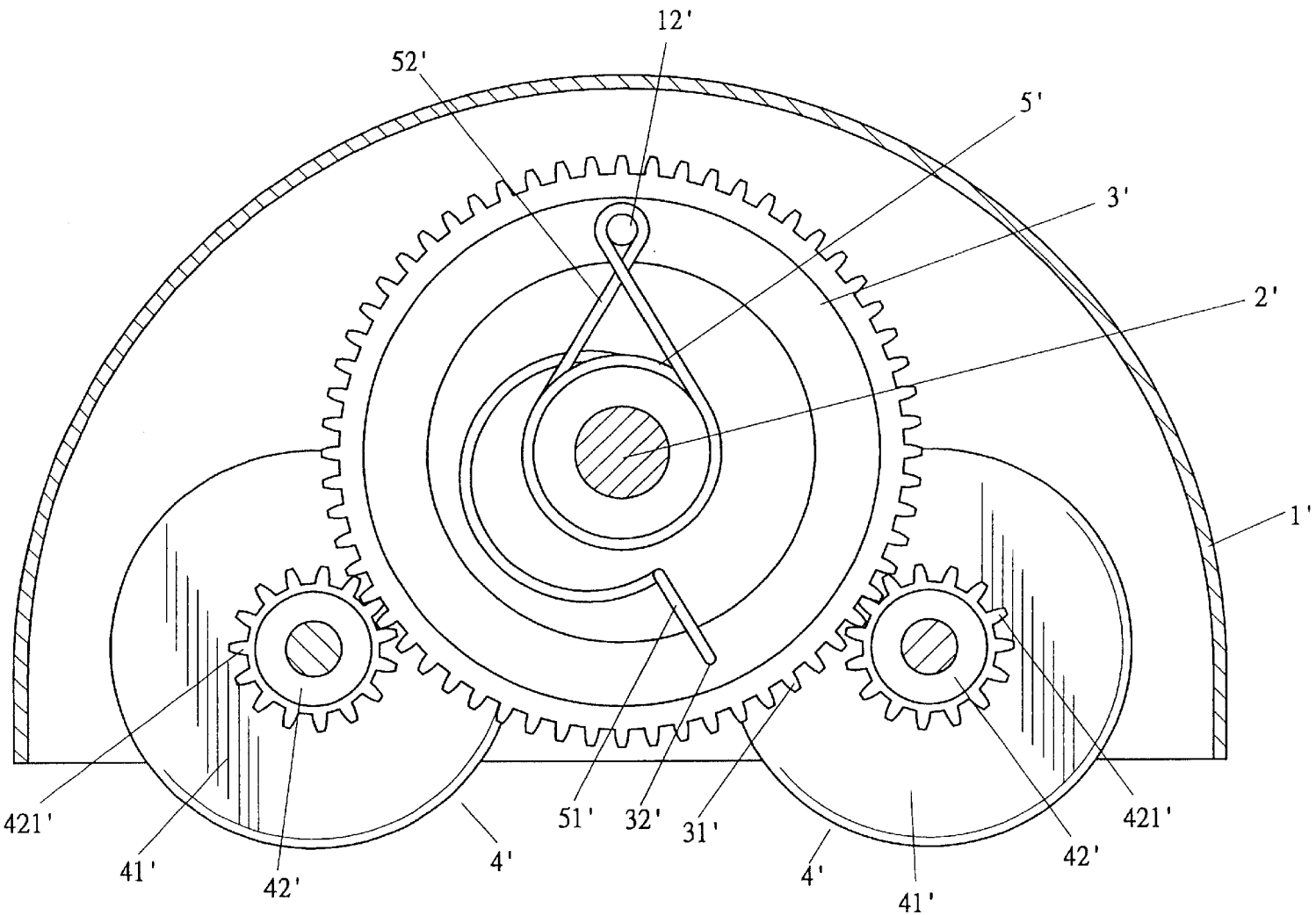
FIG. 14(PRIOR ART)
FIG. 14 is a sectional view illustrating reverse travel of the conventional exercise wheel.

FIGS. 8 through 11 illustrate a further modified embodiment that is modified from the first embodiment. The free rotating sections 321 in the first embodiment are omitted. In this embodiment, two stops 37 and 38 are provided to the main gear 3. Initially, the stops 37 and 38 are not in contact with the toothed portions 24 and 25 of the wheel assemblies 2, respectively. Referring to FIG. 9, when the exercise wheel moves in the forward direction, the stop 37 is not in contact with a portion 241 of the toothed portion 24 of the front wheel assembly 2, and the stop 38 is not in contact with the toothed portion 25 of the rear wheel assembly 2. Further forward movement of the exercise wheel is allowable until the stop 37 comes in contact with a portion 251 of the toothed portion 25 of the rear wheel assembly 2 (FIG. 10) while the stop 38 comes in contact with the portion 241 of the toothed portion 24 of the front wheel assembly 2 (FIG. 11). Thus, excessive forward travel is prevented to thereby avoid damage of the torsion springs 5 as a result of overtension.

Although the invention has been explained in relation to its preferred embodiment, it is to be understood that many other possible modifications and variations can be made without departing from the spirit and scope of the invention as hereinafter claimed.

What is claimed is:

1. An exercise wheel comprising:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the housing and a second end securely attached to the main gear;

the main gear comprising a peripheral stop surrounding at least one of the torsion springs to thereby avoid radial outward expansion of the torsion springs resulting from movements of the wheel assemblies in a rearward direction.

2. The exercise wheel as claimed in claim 1, wherein the peripheral stop comprises a plurality of annularly spaced blocks.

3. The exercise wheel as claimed in claim 1, wherein the main gear comprises two free rotating sections such that the main gear rotates freely when the toothed portions of the shafts of the wheel assemblies respectively come in contact with the free rotating sections of the main gear.

4. The exercise wheel as claimed in claim 3, wherein the free rotating sections are ratcheted sections.

5. The exercise wheel as claimed in claim 3, wherein one of the free rotating sections is a ratcheted section and the other free rotating section is a flat section without any tooth.

6. The exercise wheel as claimed in claim 5, wherein a click is generated when one of the wheel assemblies moves across the ratcheted section.

7. The exercise wheel as claimed in claim 1, wherein the chassis comprises a first stop and the main gear comprises a second stop that comes in contact with the first stop of the chassis after the wheel assemblies have moved forwardly for a distance, thereby preventing excessive forward movement of the wheel assemblies.

8. The exercise wheel as claimed in claim 1, wherein the main gear comprises two stops that respectively come in contact with the toothed portions of the wheel assemblies for preventing further forward movement of the wheel assemblies after the wheel assemblies have been moved forwardly for a distance.

9. An exercise wheel comprising:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the housing and a second end securely attached to the main gear;

the main gear comprising two free rotating sections such that the main gear rotates freely when the toothed portions of the shafts of the wheel assemblies respectively come in contact with the free rotating sections of the main gear.

10. The exercise wheel as claimed in claim 9, wherein the free rotating sections are ratcheted sections.

11. The exercise wheel as claimed in claim 9, wherein one of the free rotating sections is a ratcheted section and the other free rotating section is a flat section without any tooth.

12. The exercise wheel as claimed in claim 11, wherein a click is generated when one of the wheel assemblies moves across the ratcheted section.

13. The exercise wheel as claimed in claim 9, wherein the main gear comprises two stops that respectively come in contact with the toothed portions of the wheel assemblies for preventing further forward movement of the wheel assemblies after the wheel assemblies have been moved forwardly for a distance.

14. The exercise wheel as claimed in claim 9, wherein the chassis comprises a first stop and the main gear comprises a second stop that comes in contact with the first stop of the chassis after the wheel assemblies have moved forwardly for a distance, thereby preventing excessive forward movement of the wheel assemblies.

15. An exercise wheel comprising:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the housing and a second end securely attached to the main gear;

the main gear comprising two stops that respectively come in contact with the toothed portions of the wheel assemblies for preventing further forward movement of the wheel assemblies after the wheel assemblies have been moved forwardly for a distance.

16. An exercise wheel comprising:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear;

two torsion springs mounted around the main shaft and respectively located on both sides of the main gear, each said torsion spring including a first end securely attached to the housing, a coil portion, and a second end securely attached to the main gear; and two sleeves respectively mounted around the coil portions of the torsion springs and securely attached to the main gear, each said sleeve comprising a notch through which the second end of a respective said torsion spring extends;

wherein when the exercise wheel moves in a rearward direction, an end edge defining the notch restrains movement of the second end of the respective torsion spring and the sleeve restrains radially outward expansion of the coil portion of the respective torsion spring, thereby preventing damage to the torsion springs.

* * * * *